US011660622B1

(12) United States Patent
Feng

(10) Patent No.: US 11,660,622 B1
(45) Date of Patent: May 30, 2023

(54) FAUCET OUTLET SCREEN FILTER

(71) Applicant: Jiafu Feng, Suzhou (CN)

(72) Inventor: Jiafu Feng, Suzhou (CN)

( * ) Notice: Subject to any disclaimer, the term of this patent is extended or adjusted under 35 U.S.C. 154(b) by 0 days.

(21) Appl. No.: 17/970,139

(22) Filed: Oct. 20, 2022

(51) Int. Cl.

| | |
|---|---|
| ***B05B 1/34*** | (2006.01) |
| ***E03C 1/22*** | (2006.01) |
| ***E03C 1/08*** | (2006.01) |
| ***E03C 1/084*** | (2006.01) |
| ***E03C 1/086*** | (2006.01) |
| ***E03C 1/02*** | (2006.01) |

(52) U.S. Cl.
CPC ..... *B05B 1/34* (2013.01); *E03C 1/08* (2013.01); *E03C 1/084* (2013.01); *E03C 1/086* (2013.01); *E03C 1/22* (2013.01); *E03C 2001/026* (2013.01)

(58) Field of Classification Search
CPC ..... E03C 1/08; E03C 1/084; E03C 1/086
USPC ..... 4/287
See application file for complete search history.

(56) References Cited

U.S. PATENT DOCUMENTS

| | | | | | |
|---|---|---|---|---|---|
| 2,771,998 | A * | 11/1956 | Holden | E03C 1/084 261/6 |
| 5,467,929 | A * | 11/1995 | Bosio | B01F 23/234 239/428.5 |
| 2020/0087901 | A1* | 3/2020 | Rosko | E03C 1/084 |
| 2020/0181895 | A1* | 6/2020 | Sansum | B05B 3/008 |
| 2022/0049480 | A1* | 2/2022 | Stadtler | E03C 1/086 |

FOREIGN PATENT DOCUMENTS

| | | | | |
|---|---|---|---|---|
| IT | 1209259 B | * | 7/1989 | E03C 1/08 |

* cited by examiner

*Primary Examiner* — Christine J Skubinna
(74) *Attorney, Agent, or Firm* — Daniel M. Cohn; Howard M. Cohn

(57) ABSTRACT

A faucet outlet screen filter, for solving problems that a water outlet flow rate of faucets is too large and even water splashes out from a water pool, includes a metal mesh having a plurality of layers. The metal mesh is formed by criss-crossingly connecting a plurality of metal wires. Mesh holes of each of the plurality of the layers of the metal mesh are staggered with each other. The metal mesh includes a plurality of side walls, a bottom wall, and open space regions, where the open space regions are defined between the plurality of the side walls and the bottom wall. Water flows into a faucet through an opening of the open space regions and flows out of the faucet after being filtered by the bottom wall.

8 Claims, 6 Drawing Sheets

FAUCET OUTLET SCREEN FILTER

TECHNICAL FIELD

The present disclosure relates to faucet accessories, and in particular to a faucet outlet screen filter.

BACKGROUND

With the improvement of living quality, every family in cities and even countryside is supplied with running water using faucets. Popularization of the running water and the faucets makes our lives convenient. However, faucets currently available on the market cannot well control water flow, and water pressure of which is often too large, thereby the water flow splashes out of a water pool and makes users gotten wet. The faucets currently available on the market are all provided with faucet outlet screen filters using injection molding plastic, the faucet outlet screen filters distribute water flow by small square holes, which plays a certain role in buffering the water flow, but the faucet outlet screen filters cannot distribute the water flow in a staggered manner and cannot buffer the water flow in a multi-layered manner. Therefore, the water flow is relatively hurried and may splash out from the small square holes when the water pressure is high. In this regard, for reducing occurrence of such events, controlling a flow rate of the water flow of the running water, and bringing a good experience for the users, the present disclosure provides a novel faucet outlet screen filter for solving a problem of excessive water outlet flow rate of the faucets.

SUMMARY

Aiming at a technical problem that current faucets cannot solve problems that a water outlet flow rate of faucets is too large, and even water splashes out from a water pool, the present disclosure provides a faucet outlet screen filter.

In order to solve the technical problem mention above, the present disclosure provides a faucet outlet screen filter, including a metal mesh having a plurality of layers. The metal mesh is formed by criss-crossingly connecting a plurality of metal wires. Mesh holes of each of the plurality of the layers of the metal mesh are staggered with each other. The metal mesh includes a plurality of side walls, a plurality of bottom walls, and open space regions, where the open space regions are defined between the plurality of the side walls and the plurality of the bottom walls. Water flows into a faucet through an opening of the open space regions and flows out of the faucet after being filtered by the plurality of the bottom walls.

Furthermore, each of the plurality of the bottom walls has a first length, the opening of the open space regions has a second length, and the first length is less than the second length.

Furthermore, each of the plurality of the side walls includes an extension edge, where the extension edge extends outwards.

Furthermore, a size of each of the mesh holes of each of the plurality of the layers of the metal mesh is less than or equal to 0.6 mm.

Furthermore, the plurality of the side walls is curved surfaces.

Furthermore, the plurality of the bottom walls is generally flat surfaces.

Furthermore, each of the plurality of the layers of the metal mesh is integrally formed.

Furthermore, the plurality of the metal wires is steel having consistent material and uniform size.

Moreover, the present disclosure further provides a faucet, including a water outlet and a screen filter disposed on the water outlet. The screen filter includes a metal mesh having a plurality of layers; the metal mesh is formed by criss-crossingly connecting a plurality of metal wires. Mesh holes of each of the plurality of the layers of the metal mesh are staggered with each other. The metal mesh includes a plurality of side walls, a plurality of bottom walls, and open space regions, where the open space regions are defined between the plurality of the side walls and the plurality of the bottom walls. Water flows into a faucet through an opening of the open space regions and flows out of the faucet after being filtered by the plurality of the bottom walls.

Furthermore, a mounting portion is disposed at the water outlet for mounting the screen filter. A shape of the mounting portion is matched with the plurality of the side walls, so that the screen filter is fixed to the water outlet.

Furthermore, each of the plurality of the bottom walls has a first length, the opening of the open space regions has a second length, and the first length is less than the second length.

Furthermore, each of the plurality of the side walls includes an extension edge, where the extension edge extends outwards.

Furthermore, a size of each of the mesh holes of each of the plurality of the layers of the metal mesh is less than or equal to 0.6 mm.

Furthermore, the plurality of the side walls is curved surfaces.

Furthermore, the plurality of the bottom walls is generally flat surfaces.

Furthermore, each of the plurality of the layers of the metal mesh is integrally formed.

Furthermore, the plurality of the metal wires is steel having consistent material and uniform size.

Beneficial effects of embodiments of the present disclosure are as follows.

In the present disclosure, the faucet outlet screen filter adopts the metal wires instead of injection molding plastic to construct the metal mesh for ensuring uniformity of the mesh holes, and further ensures that the size of each of the mesh holes is less than or equal to 0.6 mm. The faucet outlet screen filter further adopts a combination of the metal mesh having the plurality of the layers for staggering the mesh holes, water flow is distributed in a staggered manner and buffered in a multi-layered manner, which ensures that the water flow gently flows and may not splash out.

BRIEF DESCRIPTION OF DRAWINGS

In order to more clearly illustrate the embodiments of the present disclosure or the technical solutions in the prior art, the drawings that need to be used in the embodiments or the prior art are briefly described below, and it is obvious that the accompanying drawings in the following description are merely some embodiments of the present disclosure, and those skilled in the art may obtain other drawings according to these drawings without involving any inventive effort.

Figure 1:
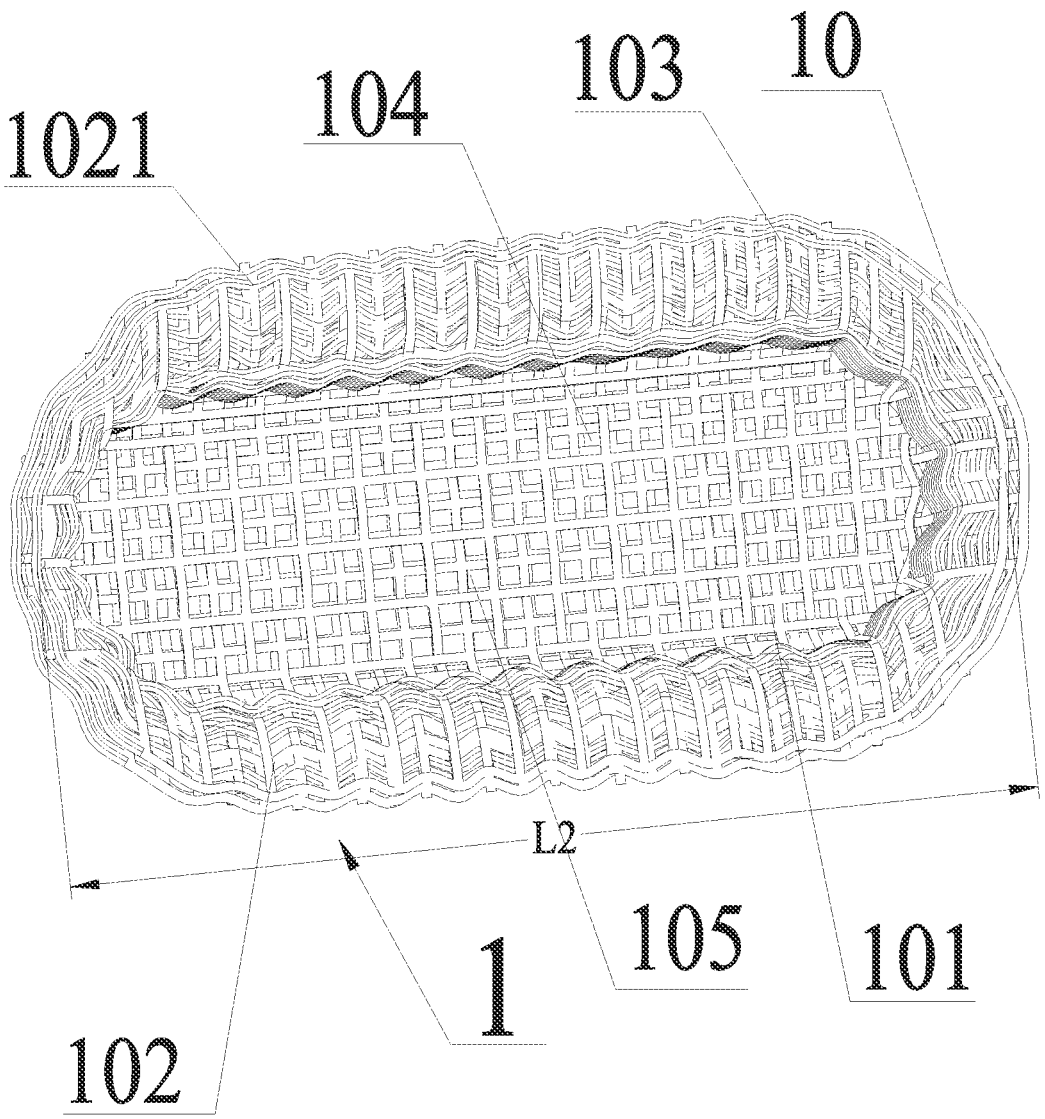
FIG. 1 is a structural schematic diagram of a faucet outlet screen filter according to one embodiment of the present disclosure.

In the drawings: 1. faucet outlet screen filter; 2. faucet; 3. metal mesh; 4. mounting portion; 22. faucet pipe; 23. faucet outlet; 101. bottom wall; 102. side wall; 103. metal wire; 104. mesh hole; 105. open space region; 1021. extension edge; L1. first length; and L2. second length.

DETAILED DESCRIPTION

The technical solutions in the embodiments of the present disclosure will be clearly and completely described below with reference to the accompanying drawings in the embodiments of the present disclosure. All other embodiments obtained by those skilled in the art based on the embodiments of the present disclosure without creative efforts shall fall within the scope of protection of the present disclosure.

Figure 2:
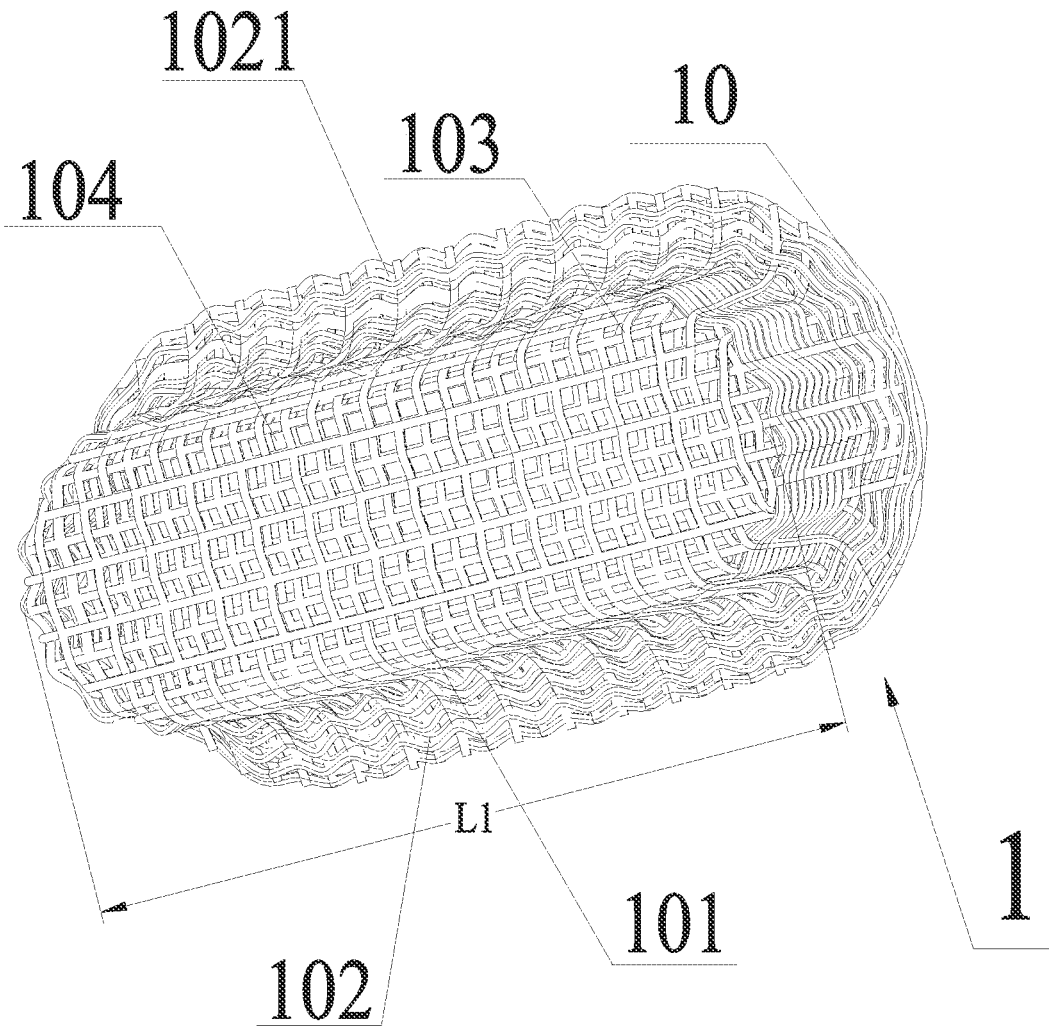
FIG. 2 is a structural schematic diagram of the faucet outlet screen filter shown in another angle of view according to one embodiment of the present disclosure.

As shown in FIG. 1, the embodiment of the present disclosure provides a faucet outlet screen filter 1, including a metal mesh 10 having a plurality of layers. The metal mesh 10 is formed by criss-crossingly connecting a plurality of metal wires 103 and includes mesh holes 104, where the mesh holes are uniform in sizes and the sizes of the mesh holes are less than or equal to 0.6 mm. The metal mesh 10 having the plurality of the layers is constructed by inlaying, and the mesh holes 104 of each of the plurality of the layers of the metal mesh 10 are staggered with each other. Bottom walls 101 of the metal mesh 10 are generally flat surfaces, and have no large protrusion and recession. Side walls 102 of the metal mesh 10 are curved surfaces, and each of the side walls includes an extension edge 1201, where the extension edge 1201 extends outwards. Open space regions 105 are space regions which are opened and formed by connecting the bottom walls 101 and the side walls 102. The plurality of the metal wires 103 is steel having consistent material and uniform size. Referring to FIG. 1 and FIG. 2, the metal mesh 10 further includes a first length L1 and a second length L2, and the first length L1 is less than the second length L2.

When in use, the faucet outlet screen filter 1 may effectively reduce a flow rate of water flow, so as to slow down the water flow. When the water flow enters the faucet outlet screen filter 1 through the open space regions 105, the faucet outlet screen filter 1 is formed by inlaying the metal mesh 10 having the plurality of the layers. The metal mesh 10 is formed by criss-crossingly connecting the plurality of metal wires 103, and since the plurality of the metal wires is made of the steel having the consistent material and the uniform size, which has high strength and high ductility and further ensures that the metal mesh 10 is not damaged under the flow rate of the water flow in a faucet. Further, the metal mesh 10 is integrally formed, so that the strength of the metal mesh 10 is further enhanced, and the metal mesh 10 is further ensured not to be damaged by the water flow. When the water flow enters the metal mesh 10, since each of the mesh holes 104 of the metal mesh 10 has a size less than or equal to 0.6 mm, the water flow may be effectively distributed, thereby decreasing the flow rate of the water flow. Moreover, the faucet outlet screen filter 1 further provides the metal mesh 10 having the plurality of the layers, and the mesh holes 104 of each of the plurality of the layers of metal mesh 10 are staggered with each other, so as to distribute the water flow in a staggered manner and decrease the flow rate of the water flow. The bottom walls 101 of the metal mesh 10 are generally flat surfaces, so that when the metal mesh 10 filters the water flow, the mesh holes 104 on the bottom walls 101 clearly distribute the water flow, the water flow is divided into a smaller amount, and the flow rate of the water flow is further decreased. The side walls 102 of the metal mash 10 are curved surfaces, and each of the side walls 102 of the metal mesh 10 further includes an extension edge 1021, such a structure may ensure that the metal mesh 10 may be effectively fixed in the faucet without displacement. The metal mesh 10 further includes the first length L1 and the second length L2, the first length L1 is a length of each of the bottom walls of the metal mesh 10, the second length L2 is a length of an opening of the metal mesh 10, and the first length L1 is less than the second length L2.

Figure 3:
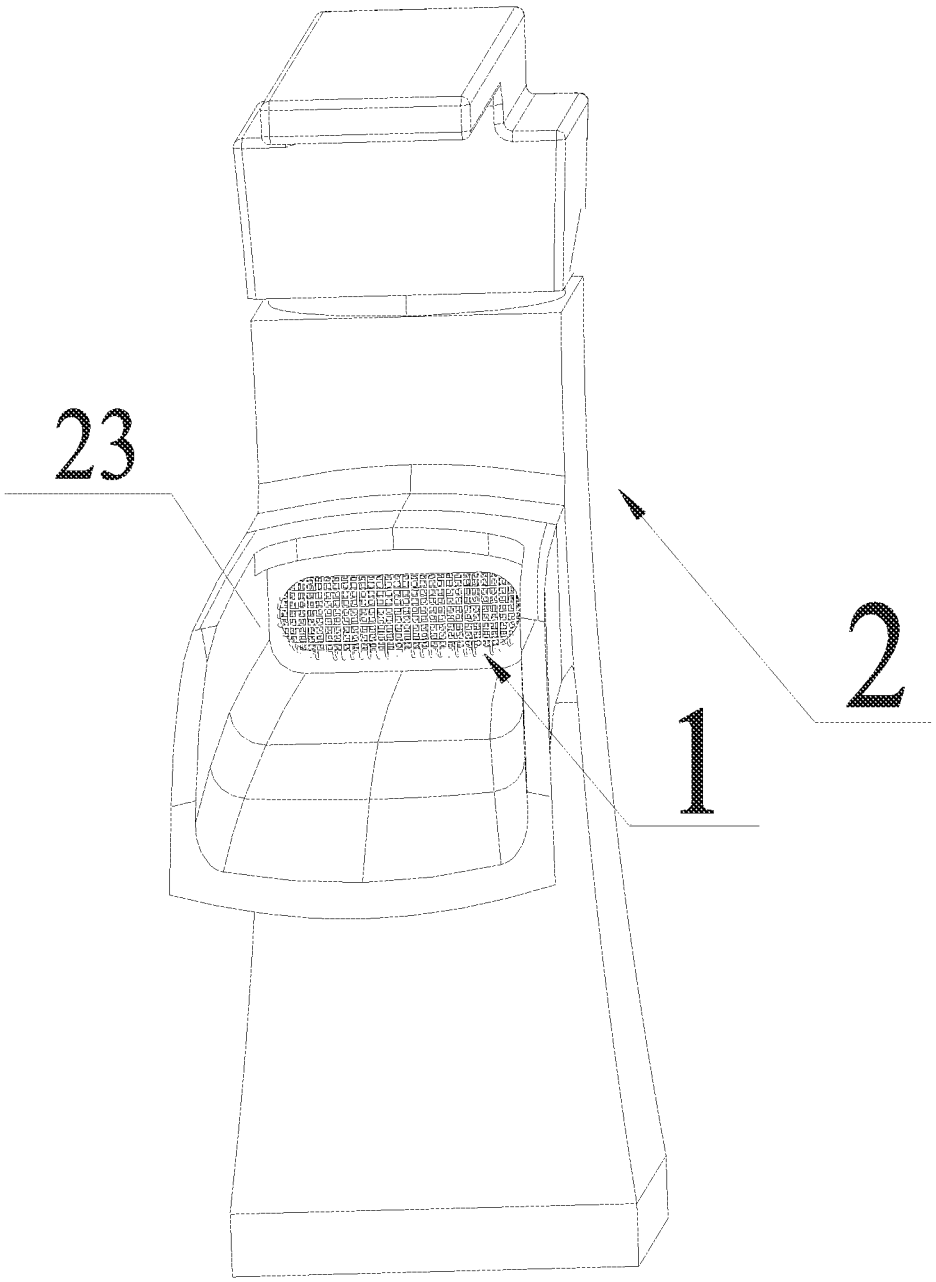
FIG. 3 is a structural schematic diagram of a faucet according to one embodiment of the present disclosure.
Figure 4:
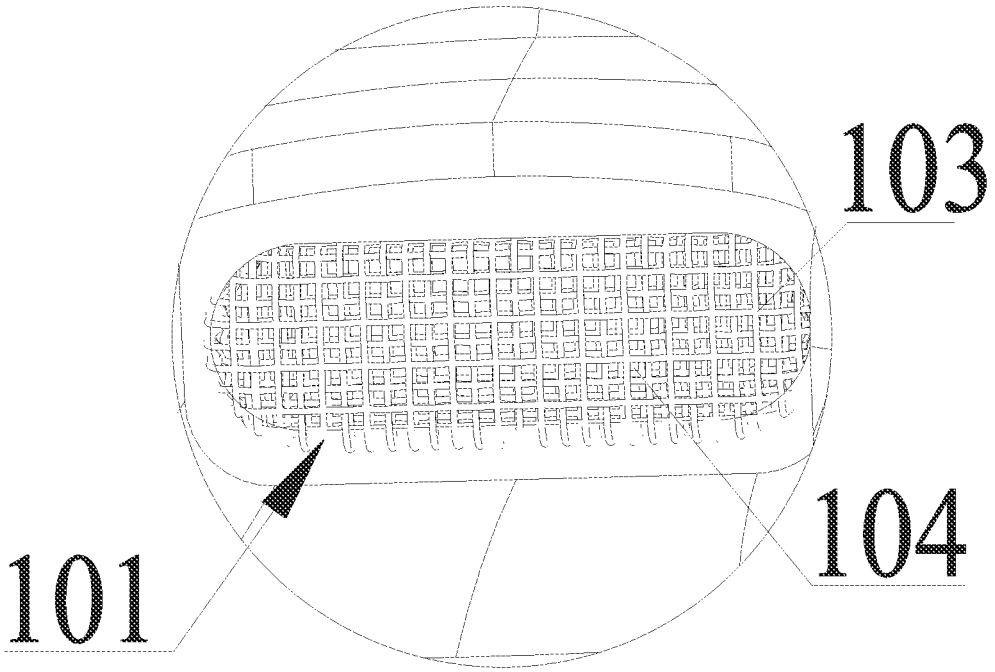
FIG. 4 is a partial structural schematic diagram of the faucet according to one embodiment of the present disclosure.
Figure 5:
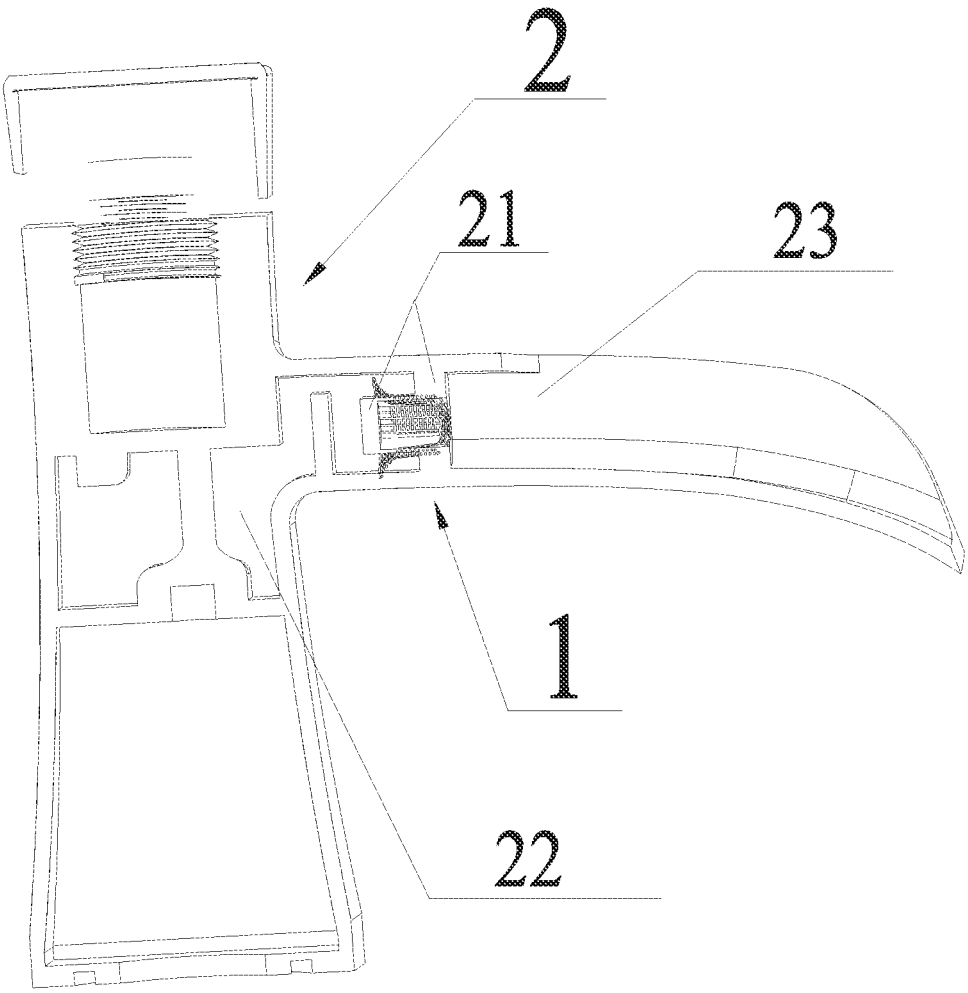
FIG. 5 is a cross-sectional structural schematic diagram of the faucet according to one embodiment of the present disclosure.
Figure 6:
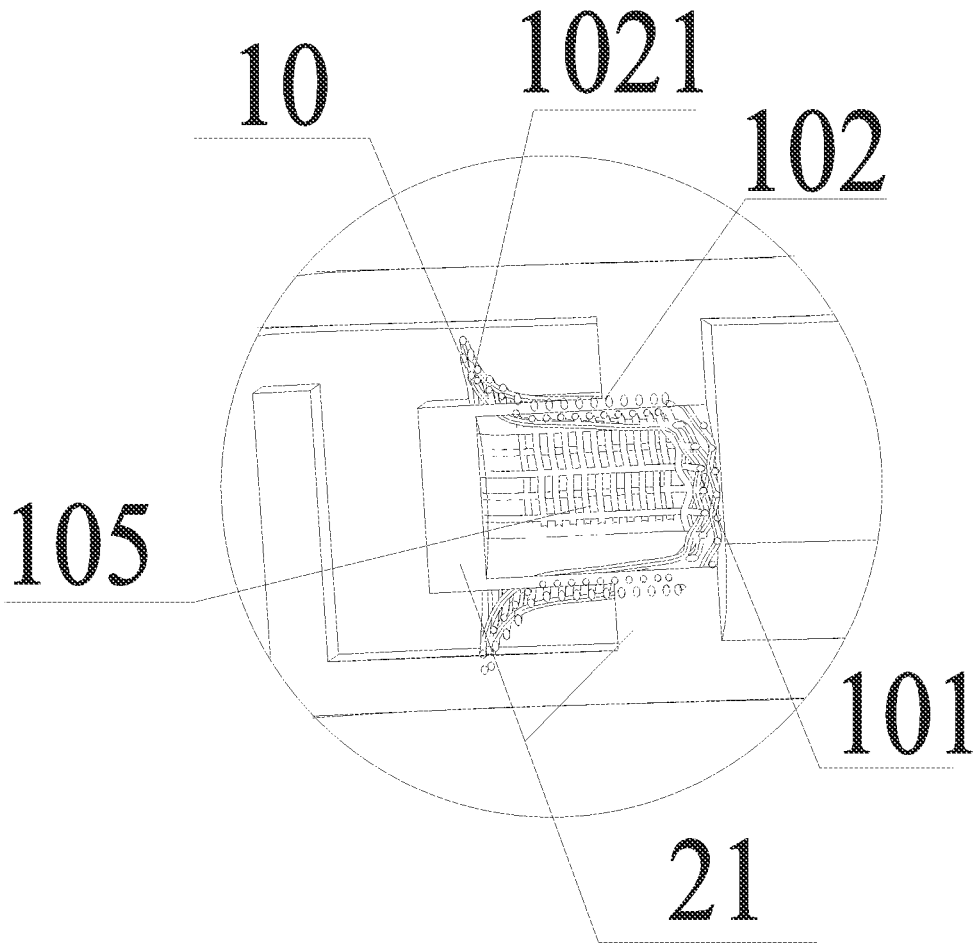
FIG. 6 is a partial cross-sectional structural schematic diagram of the faucet according to one embodiment of the present disclosure.

The present disclosure further provides a novel faucet. As show in FIG. 3, The faucet outlet screen filter 1 is embedded in a faucet 2, the bottom walls 101 of the metal mesh 10 of the faucet outlet screen filter 1 are parallel to a water outlet 23. As shown in FIG. 4, the bottom walls 101 of the metal mesh 10 completely cover the water outlet 23 of the faucet 2, and the water flow may not generate additional splash water. As shown in FIG. 5 and FIG. 6, the faucet 2 further includes a mounting portion 21, a faucet pipe 22, and the water outlet 23. The mounting portion 21 is composed of two baffles, the side walls 102 of the metal mesh 10 are in close contact with the mounting portion 21, the extension edge 1021 of each of the side walls of the metal mesh 10 is located between the two baffles of the mounting portion 21, so that the faucet outlet screen filter 1 is fixed and may not displace due to excessive flow rate of the water flow. The faucet pipe 22 is a pipe in which a water source is communicated with the faucet 2. The water outlet 23 is a portion where the faucet 2 discharge the water flow. When in use, the water flow flows into the faucet outlet screen filter 1 from the faucet pipe 22, since the faucet outlet screen filter 1 is formed by inlaying the plurality of the layers of the metal mesh 10, the water flow enters the bottom walls 101 of the metal mesh 10 after flowing through the open space regions 105, and the size of each of the mesh holes 104 on the bottom walls 101 of the metal mesh 10 is smaller than or equal to 0.6 mm, the water flow is distributed by the staggered mesh holes to further decrease the flow rate, thereby slowing down the water flow and flowing out the water flow. Moreover, the faucet outlet screen filter 1 provides the metal mesh 10 having the plurality of the layers, and the mesh holes 104 on the bottom walls of the metal mesh 10 are staggered with each other, so as to distribute the water flow in a staggered manner and buffer the water flow in a multi-layered manner, the flow rate of the water flow is further decreased, and the water flow is slowed down and does not splash out. The bottom walls 101 of the metal mesh 10 are generally the flat surfaces, and when the water flow flows by, a contact area of the water flow is small, an area where the water flow passes through is small, and resistance to the water flow is increased, thereby the flow rate of the water flow is further decreased, and the water flow gently flows out. When the bottom walls 102 decrease the flow rate of the water flow, the side walls 102 are in close contact with the mounting portion 21 for fixing the faucet outlet screen filter 1, thereby ensuring that the faucet outlet screen filter 1 may not be displaced, and further avoiding that the faucet outlet screen filter 1 is washed out of the water outlet 23 or deviates from the faucet pipe 22, and working capability of which is lost. The side walls 102 of the metal mesh 10 are curved surfaces, which is beneficial for the two baffles being in close contact the mounting portion 21. Each of the side walls 102 further includes the extension edge 1021 extending outwards between the two baffles of the mounting portion 21, which ensures that the metal mesh 10 does not have a large displacement, thereby ensuring that the faucet outlet screen filter 1 does not have a large displacement. Finally, the water flow gently flows out from the water outlet 23, so as to achieve the target of the present disclosure.

The foregoing is only a preferred embodiment of the present disclosure, and certainly cannot limit the scope of the present disclosure, and a person of ordinary skill in the art may understand that all or some of the processes of the above embodiments are implemented, and equivalent changes made according to the claims of the present disclosure are still within the scope covered by the present disclosure.

What is claimed is:

1. A faucet, comprising:

a water outlet; and a screen filter disposed on the water outlet;

wherein the screen filter comprises a metal mesh having a plurality of layers; the metal mesh is formed by criss-crossingly connecting a plurality of metal wires; mesh holes of each of the plurality of the layers of the metal mesh are staggered with each other; the metal mesh comprises a plurality of side walls, a plurality of bottom walls, and open space regions, where the open space regions are defined between the plurality of the side walls and the plurality of the bottom walls; water flows into a faucet through an opening of the open space regions and flows out of the faucet after being filtered by the plurality of the bottom walls;

wherein a mounting portion is disposed at the water outlet for mounting the screen filter; a shape of the mounting portion is matched with the plurality of the side walls, so that the screen filter is fixed to the water outlet.

2. The faucet outlet screen filter according to claim 1, wherein each of the plurality of the bottom walls has a first length, the opening of the open space regions has a second length, and the first length is less than the second length.

3. The faucet outlet screen filter according to claim 1, wherein each of the plurality of the side walls comprises an extension edge, where the extension edge extends outwards.

4. The faucet outlet screen filter according to claim 1, wherein a size of each of the mesh holes of each of the plurality of the layers of the metal mesh is less than or equal to 0.6 mm.

5. The faucet outlet screen filter according to claim 1, wherein the plurality of the side walls is curved surfaces.

6. The faucet outlet screen filter according to claim 1, wherein the plurality of the bottom walls is generally flat surfaces.

7. The faucet outlet screen filter according to claim 1, wherein each of the plurality of the layers of the metal mesh is integrally formed.

8. The faucet outlet screen filter according to claim 1, wherein the plurality of the metal wires is steel having consistent material and uniform size.

* * * * *